US009327890B1

(12) United States Patent
Connelly

(10) Patent No.: US 9,327,890 B1
(45) Date of Patent: May 3, 2016

(54) BOTTLE STACKER

(71) Applicant: Clay Connelly, Lake Havasu, AZ (US)

(72) Inventor: Clay Connelly, Lake Havasu, AZ (US)

( * ) Notice: Subject to any disclaimer, the term of this patent is extended or adjusted under 35 U.S.C. 154(b) by 0 days.

(21) Appl. No.: 13/654,382

(22) Filed: Oct. 17, 2012

Related U.S. Application Data

(60) Provisional application No. 61/548,113, filed on Oct. 17, 2011.

(51) Int. Cl.

| | |
|---|---|
| ***A47B 73/00*** | (2006.01) |
| ***B65D 71/70*** | (2006.01) |
| ***B65D 21/028*** | (2006.01) |
| ***B65D 21/02*** | (2006.01) |

(52) U.S. Cl.
CPC ..... *B65D 71/70* (2013.01); *A47B 73/006* (2013.01); *B65D 21/0202* (2013.01)

(58) Field of Classification Search
CPC ..... A47B 73/00; A47B 73/006; B65D 71/70; B65D 21/0231; B65D 81/361; B65D 21/0204; B65D 21/0224; B65D 21/0202; Y10S 206/821; A63H 33/082; A63H 33/086
USPC ..... 206/501, 511, 504, 139, 520, 446, 509, 206/519; 220/630, 513, 23.2–23.6; 211/74, 211/59.4; 446/125, 127
See application file for complete search history.

(56) References Cited

U.S. PATENT DOCUMENTS 868,838 A * 10/1907 Brewington ..... E04B 2/18 52/590.1
964,160 A * 7/1910 Hammett ..... E04B 2002/0206 52/302.4
1,139,582 A * 5/1915 Roberts ..... 217/19
2,826,906 A * 3/1958 Rice ..... A63H 33/088 160/229.1
2,935,222 A * 5/1960 O'Connell ..... B65D 21/08 206/433
3,131,829 A * 5/1964 Masser ..... 206/144
3,148,477 A * 9/1964 Bjphirn ..... A63H 33/082 446/106
3,164,252 A * 1/1965 Hosbein ..... 206/597
3,851,936 A * 12/1974 Muller ..... F16B 12/20 206/499
3,926,321 A * 12/1975 Trebilcock ..... 206/446
4,037,722 A * 7/1977 Bremer ..... 206/523
4,093,076 A * 6/1978 Newton ..... 211/74
4,162,738 A * 7/1979 Wright ..... 220/519
4,270,662 A * 6/1981 Gonzalez ..... 211/74
4,328,902 A * 5/1982 North ..... 220/23.4
4,344,530 A * 8/1982 deLarosiere ..... 206/203
4,416,373 A * 11/1983 deLarosiere ..... 206/432
4,653,651 A * 3/1987 Flum ..... 211/59.4

(Continued)

OTHER PUBLICATIONS

Ally, The Stackable Water Bottle, http://www.coolest-gadgets.com/20100215/stackable-water-bottle/, Aug. 26, 2011.

*Primary Examiner* — J. Gregory Pickett
*Assistant Examiner* — Gideon Weinerth
(74) *Attorney, Agent, or Firm* — Booth Udall Fuller, PLC

(57) ABSTRACT

A bottle stacker is disclosed for vertically stacking two or more narrow neck bottles. The bottle stacker may include a body having at least one sidewall separating a top surface from a bottom surface. At least one bottom recess may be defined in the bottom surface that is adapted to engage a top surface of a lower bottle to be stacked. At least one opposing top recess may be defined in the top surface that is adapted to engage a bottom surface of an upper bottle to be stacked. At least one through hole may connect the at least one bottom recess and the at least one top recess together in which a neck of the lower bottle to be stacked is inserted. At least one pair of opposing mating members may be on the at least one sidewall.

15 Claims, 3 Drawing Sheets

(56) References Cited

U.S. PATENT DOCUMENTS 4,685,565 A * 8/1987 Sparling ..... 206/427
4,700,837 A * 10/1987 Hammett ..... 206/427
4,865,202 A * 9/1989 Day ..... B65D 19/0018 100/2
4,911,300 A * 3/1990 Colonna ..... 206/427
4,944,400 A * 7/1990 Van Onstein et al. ..... 206/509
4,971,209 A * 11/1990 Todd ..... 211/74
5,024,067 A * 6/1991 Maier, II ..... 62/457.4
5,038,961 A * 8/1991 Watanabe et al. ..... 220/519
5,096,063 A * 3/1992 Schreiter ..... 206/391
D327,970 S 7/1992 Watanabe et al.
5,149,041 A 9/1992 Hartke
5,167,336 A * 12/1992 Lajovic ..... 220/23.6
5,178,276 A 1/1993 Sheets
5,263,605 A * 11/1993 Caton ..... B65D 71/70 206/203
5,330,050 A 7/1994 Stansbury, Jr. et al.
5,360,112 A * 11/1994 Beauchamp ..... 206/427
5,377,862 A 1/1995 Oakes et al.
5,590,786 A * 1/1997 Jaycox ..... 206/587
5,651,459 A * 7/1997 Umiker ..... 206/433
5,673,792 A * 10/1997 Aikio ..... 206/509
5,947,305 A * 9/1999 Lin ..... 211/74
6,050,044 A * 4/2000 McIntosh ..... 52/591.1
6,209,735 B1 * 4/2001 Gladstone et al. ..... 211/88.01
6,302,291 B1 * 10/2001 McCleerey ..... 220/630
6,325,210 B1 * 12/2001 Henry, Jr. ..... 206/427
6,367,645 B1 4/2002 Trygg
6,851,563 B1 2/2005 Lipari
7,150,360 B2 * 12/2006 Carlin et al. ..... 211/49.1
7,404,486 B2 * 7/2008 Smithers ..... B65D 71/70 206/139
7,413,081 B2 * 8/2008 Rogers ..... B65D 1/14 206/504
D586,225 S * 2/2009 Devereaux ..... D9/541
7,536,840 B2 * 5/2009 Ours et al. ..... 53/449
8,230,997 B1 * 7/2012 McWilliams et al. ..... 206/433
9,089,214 B2 * 7/2015 Kelly ..... A47B 81/007
2003/0141300 A1 * 7/2003 French ..... 220/23.4
2003/0205544 A1 * 11/2003 Rhodes ..... 211/74
2005/0011842 A1 * 1/2005 Gideon ..... A47F 7/283 211/74
2005/0011843 A1 * 1/2005 Dagan ..... 211/74
2005/0189243 A1 * 9/2005 Manabe ..... B65D 21/0204 206/139
2006/0000740 A1 * 1/2006 Sigur ..... B65D 21/0231 206/509
2006/0255000 A1 11/2006 Quintana
2006/0261063 A1 * 11/2006 Dyehouse ..... B65D 21/0204 220/23.4
2006/0283755 A1 * 12/2006 Slat ..... B65D 21/0231 206/509
2009/0045157 A1 * 2/2009 Panchal ..... B65D 21/0231 215/10
2009/0057248 A1 3/2009 Vishnevsky
2009/0090647 A1 * 4/2009 Panchal ..... B65D 21/0204 206/504
2012/0118848 A1 * 5/2012 Hendrickson ..... B65D 21/0231 215/40
2013/0008864 A1 * 1/2013 Davis et al. ..... 211/74
2013/0213927 A1 * 8/2013 Hendrickson ..... B65D 23/00 215/383
2014/0073217 A1 * 3/2014 Shao ..... B65D 81/361 446/77
2015/0183552 A1 * 7/2015 Kelly ..... B65D 71/70 206/433
2015/0217899 A1 * 8/2015 Ginn ..... B65D 21/0204 220/23.83
2015/0298878 A1 * 10/2015 Clark ..... B65D 71/70 206/429

* cited by examiner

BOTTLE STACKER

CROSS REFERENCE TO RELATED APPLICATION

This application claims the benefit of the filing date of U.S. Provisional Patent Application No. 61/548,113, filed on Oct. 17, 2011, the disclosure of which being hereby incorporated entirely herein by reference.

BACKGROUND

1. Technical Field

This document relates generally to a bottle stacker.

2. Background

Water is readily available in refillable and non-refillable bottles. For example, water may be bottled in 1-, 2-, 3-, 4-, and 5-gallon bottles (other sizes may also be available). The bottles are typically made of polycarbonate (PC) or polyethylene terephthalate (PET). For example, a common 5-gallon bottle has a generally cylindrical overall shape including a cylindrical sidewall, a flat circular bottom surface, and a tapered or beveled top surface that culminates into a narrow neck region and a narrow outlet.

The problem comes in how to store a plurality of bottles for later use. Multiple bottles can take up a lot of space. In conventional stacking devices, bottles are stacked on top of each other in a lying position (horizontal) in metal wire or plastic frames. However, these conventional devices do not adequately support the bottles and still take up too much space.

SUMMARY

Aspects of this document relate to a bottle stacker that enables making a stack of water bottles in a vertical fashion one atop the other. These aspects may comprise, and implementations may include, one or more or all of the components and steps set forth in the appended CLAIMS, which are hereby incorporated by reference.

A bottle stacker is disclosed for vertically stacking two or more narrow neck bottles. The bottle stacker may include a body having at least one sidewall separating a top surface from a bottom surface. At least one bottom recess may be defined in the bottom surface shaped like a top of a bottle and adapted to engage a top surface of a lower bottle to be stacked. At least one opposing top recess may be defined in the top surface shaped like a bottom of a bottle and adapted to engage a bottom surface of an upper bottle to be stacked. At least one through hole may connect the at least one bottom recess and the at least one top recess together in which a neck of the lower bottle to be stacked is inserted. At least one pair of opposing mating members may be on the at least one sidewall.

Particular implementations may include one or more or all of the following.

The at least one bottom recess, the at least one top recess, and the at least one through hole all may be concentrically aligned with one another.

The body may have an oblong shape from a top or bottom view perspective, and the at least one bottom recess may include two bottom recesses defined in the bottom surface, and the at least one opposing top recess may include two top recesses defined in the top surface.

The at least one bottom recess may include a tapered or inclined support face, and the at least one top recess may include a flat support face and at least one sidewall.

The at least one top recess may be cylindrical in shape, and the at least one bottom recess may be frustoconical in shape.

The through hole may be cylindrical in shape and partially cylindrical or partially frustoconical in shape.

At least one stacking protrusion may be defined on the top surface of the body and at least one opposing stacking recess may be defined on the bottom surface of the body.

The at least one stacking protrusion may include two opposing stacking protrusions defined on an outer perimeter of the top surface, and wherein the at least one opposing stacking recess comprises two corresponding, opposing stacking recesses on an outer perimeter of the bottom surface.

The at least one pair of opposing mating members may include at least one slot and at least one protrusion.

The at least one pair of opposing mating members may comprise three spaced apart mating members on one side of the body and three corresponding spaced apart mating members on an opposite side of the body.

The three spaced apart mating members on one side of the body may include slots and the three corresponding spaced apart mating members on an opposite side of the body comprise protrusions such that two bottle stackers can be brought into removable side-to-side engagement with one another by mating the protrusions on one bottle stacker with the corresponding slots on the other bottle stacker.

Two tongue and groove joints may be formed by the interaction of two slots with two protrusions and one sliding dovetail joint may be formed by the interaction of one slot with one protrusion.

The foregoing and other aspects, features, and advantages will be apparent to those of ordinary skill in the art from the DESCRIPTION and DRAWINGS, and from the CLAIMS.

BRIEF DESCRIPTION OF DRAWINGS

Implementations are illustrated by way of example, and not by way of limitation, in the figures of the accompanying DRAWINGS and in which like elements refer to similar elements.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

Overview

Figure 1:
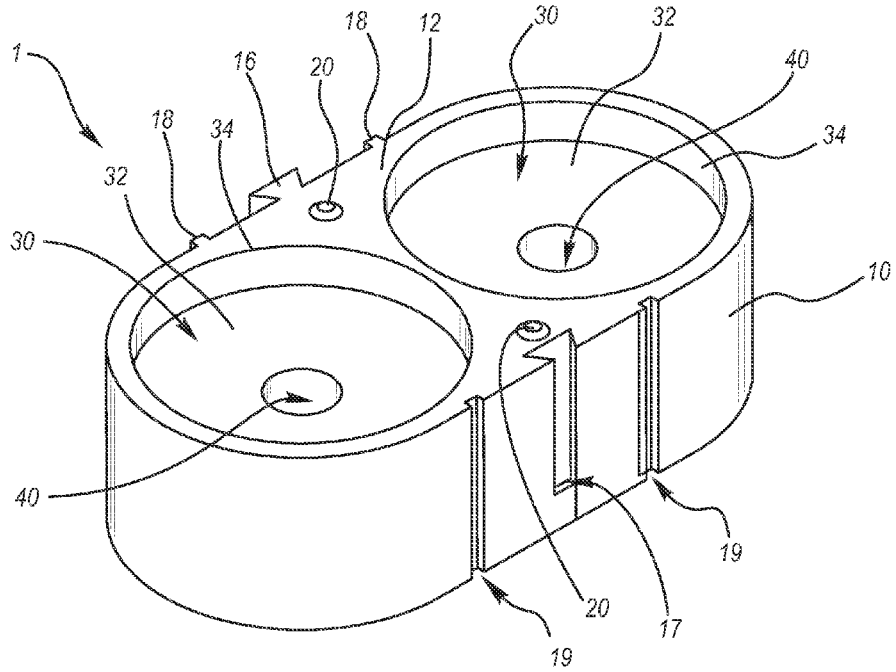
FIG. 1 is a top, perspective view of bottle stacker implementation.
Figure 2:
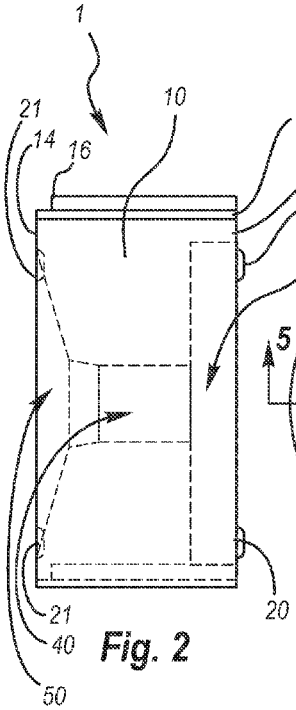
FIG. 2 is an end view of the bottle stacker implementation of FIG. 1.

This document features implementations of a bottle stacker that facilitates the stacking of bottles in a vertical fashion, one atop the other. There are many features of such implementations disclosed herein, of which one, a plurality, or all features or steps may be used in any particular implementation.

In the following description, reference is made to the accompanying DRAWINGS which form a part hereof, and which show by way of illustration possible implementations. It is to be understood that other implementations may be utilized, and structural, as well as functional and procedural, changes may be made without departing from the scope, applicability or configuration of this document in any way. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

Structure

There are a variety of implementations of a bottle stacker. Implementations of a bottle stacker may generally include a body. The body may define at least one bottom recess that is shaped like a top of a water bottle and at least one top recess shaped like a bottom of a water bottle. The bottom recess and the top recess may be connected together via a through hole in which the neck of a water bottle is inserted when the bottle stacker is in use. The bottom recess, the top recess, and the through hole all may be concentrically aligned with one another.

The body may further define at least one stacking protrusion on its top surface as well as at least one opposing stacking recess on its bottom surface so that multiple bottle stackers can be stacked together safely when not in use.

The body may further define at least one mating member on a side or end thereof as well as at least one corresponding mating member on an opposite side or end thereof so that multiple bottle stackers can be removably coupled to one another (side by side or end to end) safely when in use to form a more stable stack of water bottles. For example, the mating members may be slots and protrusions that when removably coupled together form a joint of a particular shape (e.g., tongue and groove joint, sliding dovetail joint, etc.).

For the exemplary purposes of this disclosure, turning to FIGS. 1-5, bottle stacker 1 is disclosed and is one particular implementation for use with four 5-gallon bottles for example.

Bottle stacker 1 has a body support 10. Body support 10 has an oblong shape from a top or bottom view perspective; an extended circle with parallel sides and semi-circular ends whose diameters are equal to the width of the parallel sides.

Body support 10 has at least one sidewall, a bottom surface 14 that defines two bottom recesses 50 each shaped like a bottom of a water bottle and a top surface 12 that defines two top recesses 30 each shaped like a top of a water bottle. The two bottom recesses 50 and the two top recesses 30 are paired to one another such that each pair is axially spaced from and generally parallel to one another.

Each bottom recess 50 comprises a tapered or inclined support face 52. Each top recess 30 comprises a flat support face 32 and at least one sidewall 34. In this implementation, each top recess 30 is generally cylindrical in shape and each bottom recess is generally frustoconical in shape.

Each bottom recess and top recess pair is connected together via a through hole 40 in which the neck of a water bottle is inserted when the bottle stacker 1 is in use. Through hole 40 has a cylindrical top opening, as well as a bottom opening that can be frustoconical in shape as depicted to provide a funnel-like shape to facilitate an easier insertion therein of the neck of a water bottle for example. However, in other implementations the through hole could be generally cylindrical in shape.

The bottom recesses 50, the top recesses 30, and the connecting through holes 40 all are concentrically aligned with one another. Thus, bottle stacker 1 allows two upper bottles to be stacked vertically above two lower bottles. When the four bottles are so placed in vertical, stacked position, the central vertical axes of each of the two bottle pairs is aligned along a common vertical line so that a very stable stacking arrangement is maintained.

Body 10 further defines two opposing stacking protrusions 20 on an outer perimeter of top surface 12 between the two bottle top recesses 30, as well as two corresponding, opposing stacking recesses 21 on an outer perimeter of bottom surface 14 between the two bottle bottom recesses 50 so that multiple bottle stackers 1 can be stacked together safely when not in use and stay in alignment. Protrusions 20 and recesses 21 may have any rectilinear or curvilinear shape that allows them to correspond and mate with one another when bottle stackers 1 are stacked on top of each other for storage for example.

Body 10 also defines three spaced apart mating members on one side thereof as well as three corresponding spaced apart mating members on the opposite side thereof so that multiple bottle stackers 1 can be removably coupled to one another side to side safely when in use to form a more stable stack of water bottles.

Figure 3:
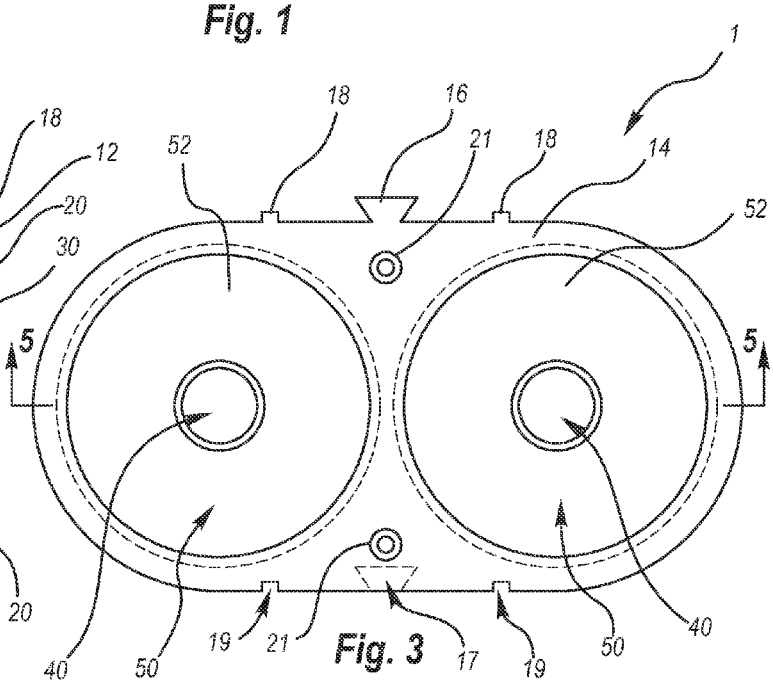
FIG. 3 is a bottom view of the bottle stacker implementation of FIG. 1.
Figure 4:
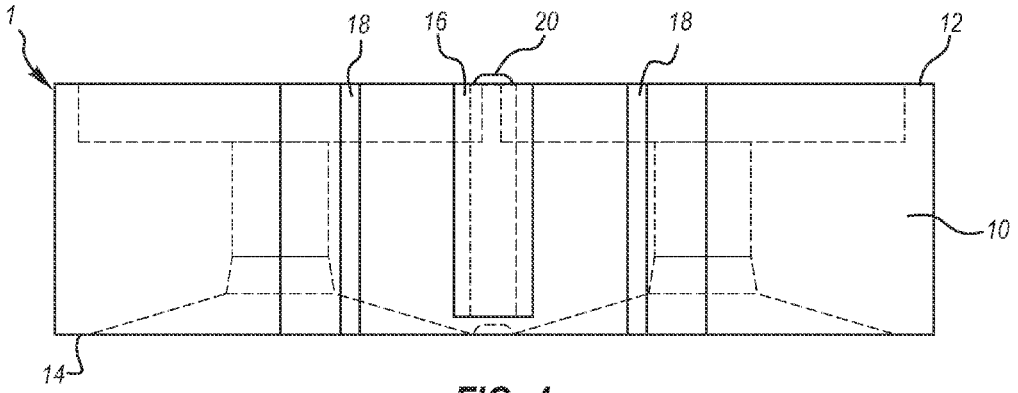
FIG. 4 is a side view of the bottle stacker implementation of FIG. 1.
Figure 5:
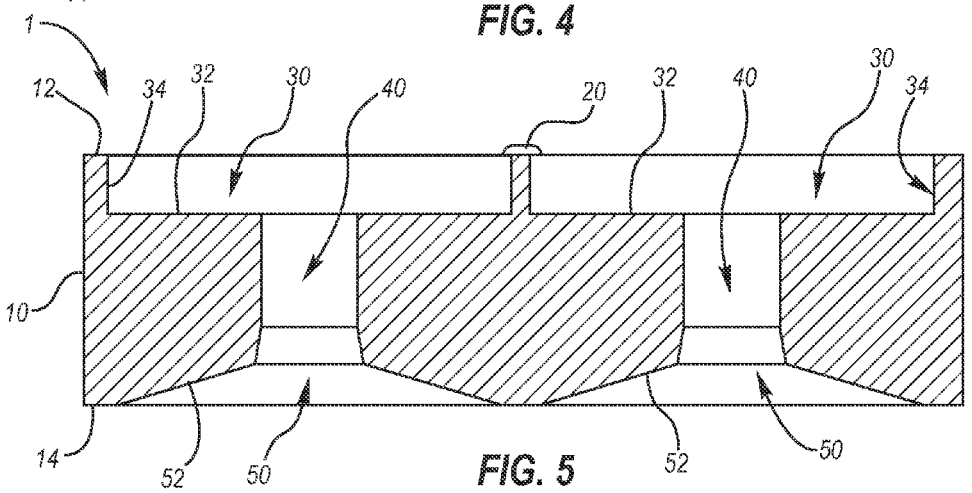
FIG. 5 is a cross-sectional view of the bottle stacker implementation of FIG. 1 taken along line 5-5 of FIG. 3.
Figure 7:
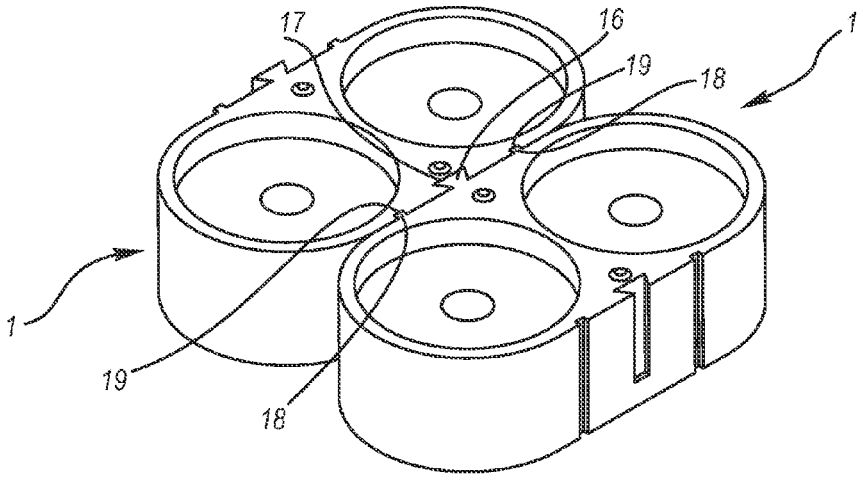
FIG. 7 is a top perspective view of two of the bottle stacker implementations of FIG. 1 removably coupled together.

As depicted in FIGS. 1, 3, and 7, the mating members may be slots 17 and 19 defined in a side of body 10 and corresponding protrusions 16 and 18 defined on an opposing side of body 10. Slots 19 and protrusions 18 run from the top surface to the bottom surface. Slot 17 and protrusion 16 run from the top surface but do not quite go through to the bottom surface.

Thus, two bottle stackers 1 can be brought into removable side-to-side engagement with one another by mating protrusions 16 and 18 on one bottle stacker 1 with corresponding slots 17 and 19 on the other bottle stacker 1 to form a joint of a particular shape to removably couple the bottle stackers 1 together. In this particular implementation, when two bottle stackers 1 are removably coupled to one another, two tongue and groove joints are formed by the interaction of slots 19 with protrusions 18 and one sliding dovetail joint is formed by the interaction of slot 17 with protrusion 16.

Other Implementations

Other implementations are possible for a wide variety of applications.

For the exemplary purposes of this disclosure, a body may define any number of bottom and corresponding top bottle recesses in any arrangement. That is a body of a bottle stacker implementation may define recesses to accommodate two bottles (one on top of one), four bottles (two on top of two), six bottles (three on top of three), eight bottles (four on top of four), and so on.

For the exemplary purposes of this disclosure, the body of a bottle stacker implementation not only could have an oblong shape from a top or bottom view perspective, but it may have a rectangular, square, or circular shape from a top or bottom view perspective.

Figure 6:
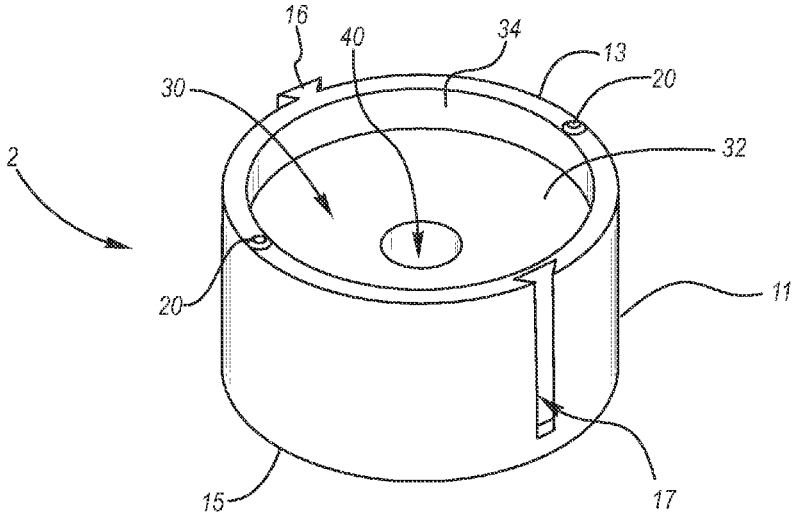
FIG. 6 is a top perspective view of another bottle stacker implementation.

For the exemplary purposes of this disclosure, bottle stacker 2 is depicted in FIG. 6. Bottle stacker 2 is similar to bottle stacker 1 previously described; the principal difference being bottle stacker 2 accommodates two bottles (one on top of one).

That is, bottle stacker 2 has a body support 11. Body support 11 has a circular shape from a top or bottom view perspective.

Body support 11 has at least one sidewall, a bottom surface 15 that defines one bottom recess shaped like a bottom of a water bottle and a top surface 13 that defines top recess 30 shaped like a top of a water bottle. The bottom recess and the top recess 30 are paired to one another such that the pair is axially spaced from and generally parallel to one another.

The bottom recess comprises a tapered or inclined support face. The top recess 30 comprises a flat support face 32 and at least one sidewall 34. In this implementation, the top recess 30 is generally cylindrical in shape and the bottom recess is generally frustoconical in shape.

The bottom recess and top recess pair is connected together via a through hole 40 in which the neck of a water bottle is inserted when the bottle stacker 2 is in use. Through hole 40 has a cylindrical top opening, as well as a bottom opening that can be frustoconical in shape to provide a funnel-like shape to facilitate an easier insertion therein of the neck of a water bottle for example. However, in other implementations the through hole could be generally cylindrical in shape.

The bottom recess, the top recess 30, and the connecting through hole 40 all are concentrically aligned with one another. Thus, bottle stacker 2 allows one upper bottle to be stacked vertically above one lower bottle. When the two bottles are so placed in vertical, stacked position, the central vertical axis of the bottle pair is aligned along a common vertical line so that a very stable stacking arrangement is maintained.

Body 11 further defines two opposing stacking protrusions 20 on an outer perimeter of top surface 13 adjacent bottle top recess 30, as well as two corresponding, opposing stacking recesses on an outer perimeter of a bottom surface so that multiple bottle stackers 2 can be stacked together safely when not in use and stay in alignment. Protrusions 20 and corresponding recesses may have any rectilinear or curvilinear shape that allows them to correspond and mate with one another when bottle stackers 2 are stacked on top of each other for storage for example.

Body 11 also defines one mating member on one side thereof as well as one corresponding mating member on the opposite side thereof so that multiple bottle stackers 2 can be removably coupled to one another side to side safely when in use to form a more stable stack of water bottles.

The mating members may be slot 17 defined in a side of body 11 and corresponding protrusion 16 defined on an opposing side of body 11. Thus, two bottle stackers 2 can be brought into removable side-to-side engagement with one another by mating protrusion 16 on one bottle stacker 2 with corresponding slot 17 on the other bottle stacker 2 to form a joint of a particular shape to removably couple the bottle stackers 2 together. In this particular implementation, when two bottle stackers 2 are removably coupled to one another, one sliding dovetail joint is formed by the interaction of slot 17 with protrusion 16.

For the exemplary purposes of this disclosure, since bottom recesses are each shaped like a bottom of a water bottle and op recesses are each shaped like a top of a water bottle, the top and bottom recesses may have any number of shapes. For example, some water bottles have square bottoms. As such, in some implementations top recesses do not have to be cylindrical. They can be square as well, having a flat support face and four sidewalls. Additionally, the top surfaces of some water bottles are not tapered or beveled or inclined. They can be flat. As such, in some implementations bottom recesses do not have to have a tapered or inclined support face. They can be cylindrically shaped for example and have a flat support face.

For the exemplary purposes of this disclosure, mating elements could be located on ends of bodies in lieu of or in addition to the sides of bodies for end to end coupling of bottle stacker implementations as well.

For the exemplary purposes of this disclosure, only one corresponding pair of mating elements (as depicted in FIG. 6) can be included. This would still allow bottle stackers to be removably coupled together. Having two or three pairs (as depicted in the FIGS. 1-5 and 7) of mating elements would provide even more stability, securement, and alignment.

Further implementations are within the CLAIMS.

Specifications, Materials, Manufacture, Assembly

It will be understood that implementations are not limited to the specific components disclosed herein, as virtually any components consistent with the intended operation of a bottle stacker implementation may be utilized. Accordingly, for example, although particular components and so forth, are disclosed, such components may comprise any shape, size, style, type, model, version, class, grade, measurement, concentration, material, weight, quantity, and/or the like consistent with the intended operation of a bottle stacker. Implementations are not limited to uses of any specific components, provided that the components selected are consistent with the intended operation of a bottle stacker.

Accordingly, the components defining any implementation may be formed of any of many different types of materials or combinations thereof that can readily be formed into shaped objects provided that the components selected are consistent with the intended operation of an apparatus for holding a portable media device. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; rubbers (synthetic and/or natural), and/or other like materials; glasses (such as fiberglass), carbon-fiber, aramid-fiber, any combination thereof, and/or other like materials; composites and/or other like materials; metals, such as zinc, magnesium, titanium, copper, iron, steel, carbon steel, alloy steel, tool steel, stainless steel, spring steel, aluminum, any combination thereof, and/or other like materials; alloys, such as aluminum alloy, titanium alloy, magnesium alloy, copper alloy, any combination thereof, and/or other like materials; wood; any other suitable material; and/or any combination thereof.

Various implementations may be manufactured using conventional procedures as added to and improved upon through the procedures described here. Some components defining implementations may be manufactured simultaneously and integrally joined with one another, while other components may be purchased pre-manufactured or manufactured separately and then assembled with the integral components.

Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a rivet, a pin, and/or the like), wiring, any combination thereof, and/or the like for example, depending on, among other considerations, the particular material forming the components.

It will be understood that the assembly of bottle stacker implementations are not limited to the specific order of steps as disclosed in this document. Any steps or sequence of steps of the assembly or installation of implementations indicated herein are given as examples of possible steps or sequence of steps and not as limitations, since various assembly and installation processes and sequences of steps may be used.

Use

The aspects and implementations listed here, and many others, will become readily apparent to those of ordinary skill in the art from this disclosure. Those of ordinary skill in the art will readily understand the versatility with which this disclosure may be applied.

Implementations of a bottle stacker are particularly useful for plastic drinking-water bottles, such as 5-gallon water bottles, and allow them to be supported (e.g., stacked efficiently on top of and/or next to each other). However, implementations are not limited to uses relating to 5-gallon water bottles. Rather, implementations may also be used in a variety of different sized and/or shaped bottle applications with similar results.

Figure 8:
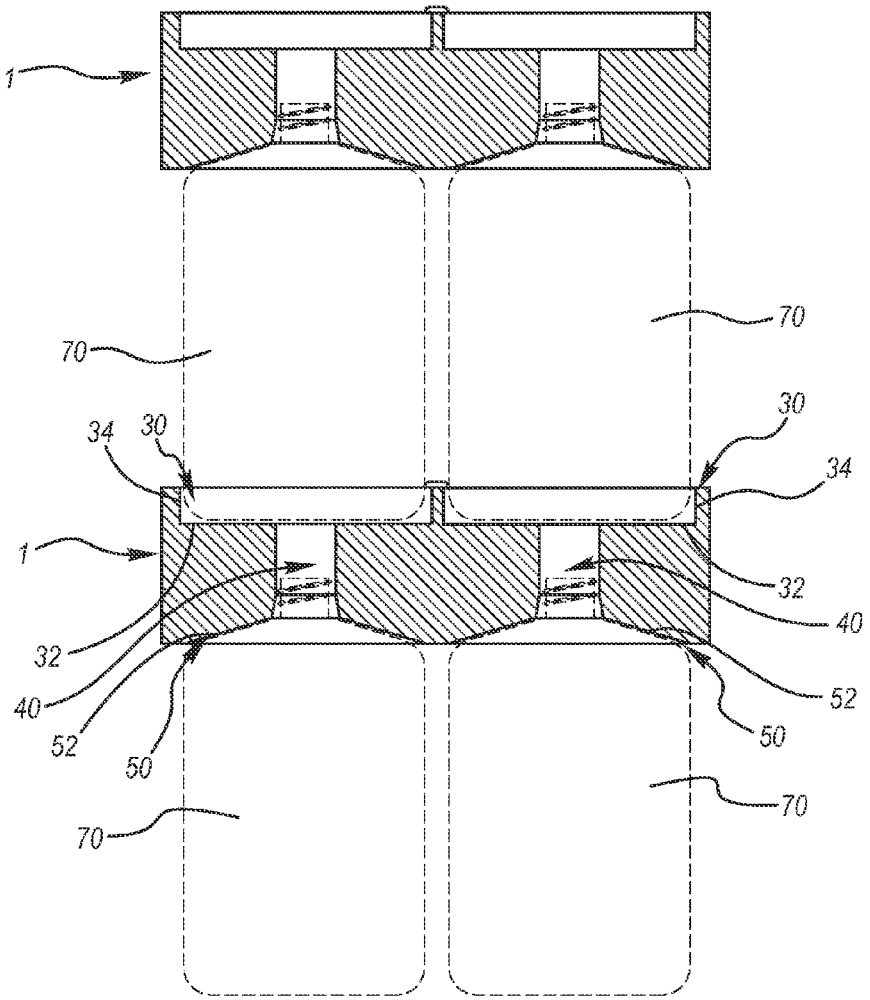
FIG. 8 is a side view of two of the bottle stacker implementations of FIG. 1 depicted in cross-section as in FIG. 5 in use stacking water bottles in a vertical fashion one atop the other.

In describing the use of bottle stacker implementations further, reference is made to FIG. 8 that depicts a stack of water bottles. To form the stack, a first set of two water bottles 70 can be placed on a floor for example. A first bottle stacker 1 can then be placed on top of the first set of water bottles 70. The top surfaces of each water bottle 70 support faces 52 of the bottom recesses 50 so that the necks of water bottles 70 are inserted into the respective through holes 40. Next, a second set of two water bottles 70 can be placed on top of the first bottle stacker 1. The bottom surfaces of each water bottle 70 are supported by faces 32 and sidewalls 34 of the top recesses 30.

Thus, bottle stacker 1 allows two upper bottles 70 to be stacked vertically above two lower bottles 70. When the four bottles 70 are so placed in vertical, stacked position, the central vertical axes of each of the two bottle pairs is aligned along a common vertical line so that a very stable stacking arrangement is maintained.

Alternatively, the bottle stacking arrangement depicted in FIG. 8 could be rotated 180 degrees. That is, a first bottle stacker 1 could be placed on the floor with its top surface down. Then a first set of two water bottles 70 can be placed neck down into the first bottle stacker 1 so that the necks of water bottles 70 are inserted into the respective through holes 40. The top surfaces of each water bottle 70 are supported by faces 52 of the bottom recesses 50. Next, a second bottle stacker 1 can then be placed top surface down on top of the first set of water bottles 70. The bottom surfaces of each water bottle 70 support faces 32 and sidewalls 34 of the top recesses 30. Then, a second set of two water bottles 70 can be placed neck down into the second bottle stacker 1 so that the necks of water bottles 70 are inserted into the respective through holes 40. The top surfaces of each water bottle 70 are supported by faces 52 of the bottom recesses 50.

In places where the description above refers to particular implementations of a bottle stacker, it should be readily apparent that a number of modifications may be made without departing from the spirit thereof. The presently disclosed aspects and implementations are, therefore, to be considered in all respects as illustrative and not restrictive.

The invention claimed is:

1. A 5-gallon water bottle stacker for vertically stacking two or more narrow neck 5-gallon water bottles, the bottle stacker comprising:

a body having at least one sidewall separating a top surface from a bottom surface;

at least one bottom recess defined in the bottom surface shaped like a top surface of a 5-gallon water bottle and adapted to interface a top surface between a narrow neck and a bottom surface of a lower bottle to be stacked, the at least one bottom recess comprising an inclined support face that extends to the through hole, wherein the support face is inclined from the bottom surface to at least one through hole;

at least one opposing top recess defined in the top surface shaped like a bottom of a 5-gallon water bottle and adapted to engage a bottom surface of an upper 5-gallon water bottle to be stacked, the at least one opposing top recess comprising a flat support face and at least one sidewall;

the at least one through hole connecting the at least one bottom recess and the at least one top recess together, the at least one through hole being sized to receive the narrow neck of the lower 5-gallon water bottle to be stacked; and a first pair of opposing mating members on the at least one sidewall extending between the top surface and the bottom surface substantially parallel to an axis of the at least one through hole, the first pair of opposing mating members comprising a dovetail protrusion and a dovetail slot within the body opposite the dovetail protrusion.

2. The 5-gallon water bottle stacker of claim 1 wherein the at least one bottom recess, the at least one top recess, and the at least one through hole all are concentrically aligned with one another.

3. The 5-gallon water bottle stacker of claim 1 wherein the body has an oblong shape from a top or bottom view perspective, wherein at least one bottom recess comprises two bottom recesses defined in the bottom surface, and wherein the at least one opposing top recess comprises two top recesses defined in the top surface.

4. The 5-gallon water bottle stacker of claim 1 wherein the at least one top recess is cylindrical in shape, and wherein the at least one bottom recess is frustoconical in shape.

5. The 5-gallon water bottle stacker of claim 1 the through hole is one of cylindrical in shape and partially cylindrical and partially frustoconical in shape.

6. The 5-gallon water bottle stacker of claim 1 further comprising at least one stacking protrusion defined on the top surface of the body and at least one opposing stacking recess defined on the bottom surface of the body.

7. The 5-gallon water bottle stacker of claim 6 wherein the at least one stacking protrusion comprises two opposing stacking protrusions defined on an outer perimeter of the top surface, and wherein the at least one opposing stacking recess comprises two corresponding, opposing stacking recesses on an outer perimeter of the bottom surface.

8. The 5-gallon water bottle stacker of claim 1 further comprising a second pair of opposing mating members on the at least one side wall extending between the top surface and the bottom surface substantially parallel to an axis of the at least one through hole, the second pair of opposing mating members comprising at least one groove slot and at least one tongue protrusion opposite the at least one groove slot.

9. The 5-gallon water bottle stacker of claim 8 wherein the at least one groove slot comprises two groove slots and the at least one tongue protrusion comprises two tongue protrusions opposite the two groove slots such that two bottle stackers can be brought into removable side-to-side engagement with one another by mating the tongue protrusions on one bottle stacker with the corresponding tongue slots on the other bottle stacker.

10. The 5-gallon water bottle stacker of claim 9 wherein two tongue and groove joints are formed by the interaction of the two tongue slots with the two groove protrusions and one sliding dovetail joint is formed by the interaction of the dovetail slot with the dovetail protrusion.

11. The 5-gallon water bottle stacker of claim 1, wherein the mating members extend at least partially from the top surface toward the bottom surface.

12. The 5-gallon water bottle stacker of claim 9, wherein the two groove slots and the two tongue protrusions extend from the top surface to the bottom surface and the dovetail groove slot extends only partially from the top surface toward the bottom surface.

13. A bottle stacker for vertically stacking two or more at least one-gallon narrow neck bottles, the bottle stacker comprising:

a body comprising a top surface and a bottom surface opposite the top surface;

at least two inclined bottom recesses in the bottom surface each shaped complementary to a top surface of an at least one-gallon narrow neck bottle positioned between a narrow neck and a bottom surface of the at least one-gallon narrow neck bottle and adapted to interface a top surface of a lower at least one-gallon narrow neck bottle to be stacked;

at least two opposing top recesses in the top surface each shaped complementary to a bottom of an at least one-gallon narrow neck bottle and adapted to engage a bottom surface of an upper at least one-gallon narrow neck bottle to be stacked;

at least two through holes each connecting a different one of the at least two inclined bottom recesses to a different one of the at least two top recesses, wherein the at least two through holes are each sized to receive a neck of a lower at least one-gallon narrow neck bottle to be stacked and the at least two inclined bottom recesses extend from the bottom surface to the at least two through holes, respectively;

at least one sidewall extending between the top surface and the bottom surface; and at least one pair of opposing mating members on the at least one sidewall, the at least one pair of opposing mating members extending between the top surface and the bottom surface substantially parallel to an axis of the at least one through hole.

14. The bottle stacker of claim 13, wherein the mating members extend at least partially from the top surface toward the bottom surface.

15. The bottle stacker of claim 14, wherein the mating members comprise a first and a second tongue and groove mating members on each side of the body extending from the top surface to the bottom surface and a first dovetail mating members on each side of the body between the first and second mating members and extending from the top surface partially towards the bottom surface.

* * * * *